US005806135A

United States Patent [19]

Earle

[11] Patent Number: 5,806,135

[45] Date of Patent: Sep. 15, 1998

[54] APPARATUS FOR REMOVING DUST FROM AN OBJECT

[76] Inventor: John R. Earle, 4712 Admiralty Way, Ste. 550, Marina del Rey, Calif. 90292

[21] Appl. No.: 711,868

[22] Filed: Sep. 12, 1996

[51] Int. Cl.[6] ..... A47L 13/16

[52] U.S. Cl. ..... 15/244.4; 15/104.001

[58] Field of Search ..... 15/104.001, 209.1, 15/244.1, 244.4; 428/90

[56] References Cited

U.S. PATENT DOCUMENTS

| | | | |
|---|---|---|---|
| 1,877,527 | 9/1932 | Moran | 15/244.4 |
| 1,987,390 | 1/1935 | Davis | 15/244.4 |
| 2,190,427 | 2/1940 | Johnson | 15/244.1 |
| 3,411,931 | 11/1968 | Burns et al. . | |
| 3,671,373 | 6/1972 | Grewe . | |
| 4,096,289 | 6/1978 | Nischwitz et al. . | |
| 4,174,415 | 11/1979 | Bethe . | |
| 4,385,588 | 5/1983 | Bennetot . | |
| 4,418,106 | 11/1983 | Landler et al. . | |
| 4,504,517 | 3/1985 | Hefele . | |
| 4,621,005 | 11/1986 | Long et al. . | |
| 4,765,014 | 8/1988 | Moss et al. . | |
| 4,856,136 | 8/1989 | Janssen . | |
| 4,969,226 | 11/1990 | Seville | 15/244.4 |
| 5,033,155 | 7/1991 | Klotz . | |
| 5,336,330 | 8/1994 | Shumway et al. | 15/244.1 |

FOREIGN PATENT DOCUMENTS

| | | | |
|---|---|---|---|
| 1597455 | 9/1981 | United Kingdom | 15/244.4 |

OTHER PUBLICATIONS

Photograph of StatBlock, ©1994.

*Primary Examiner*—Terrence Till

*Attorney, Agent, or Firm*—Blakely, Sokoloff, Taylor & Zafman LLP

[57] ABSTRACT

An apparatus for removing dust from an object has a resilient body having a first substantially flat surface and a second surface having a plurality of spaced-apart projections. A flock coating covers at least the first and second surfaces. The flat surface of the apparatus is used for removing dust from a generally flat surface, whereas the surface with spaced-apart projections is used for removing dust from more complex surfaces and from nooks which cannot be reached using the flat surface of the apparatus. The resilient body is preferably made of a foam material. Although the body may be of virtually any shape, polyhedral shapes are preferred in order to provide a plurality of dusting surfaces.

15 Claims, 1 Drawing Sheet

APPARATUS FOR REMOVING DUST FROM AN OBJECT

BACKGROUND OF THE INVENTION

1. Field of the Invention

The present invention relates to the field of cleaning implements, and particularly to an apparatus for removing dust from the surfaces of an object.

2. Background

Since prehistoric times, dust has been an unwelcome intruder in the human environment. The conventional method for removing dust from surfaces of an object, namely wiping the surfaces with a rag, cloth or even a feather, has not changed in thousands of years. This method is generally effective; however, the implements are unsightly. This inventor is aware of a device comprising a cube of foam material covered with electrostatically applied flocking. This device is specifically intended for removing dust from computer screens and other surfaces in an office environment. At least one surface of the cube may be devoted to a silk-screened advertising message. The device is thus intended to be left on display as an advertising and promotional item.

While the aforementioned device is effective in removing dust from a flat surface, it is less useful for removing dust from deeply contoured surfaces or from corners, nooks and crannies.

Flock-covered foam is known for use in other applications as well. For example, U.S. Pat. No. 4,856,136 issued to Janssen discloses a paint applicator having a head portion made of foam and electrostatically coated with flocking fibers.

SUMMARY OF THE INVENTION

The present invention is an improved apparatus for removing dust from an object. In a preferred embodiment, the apparatus comprises a resilient body having a first substantially flat surface and a second surface having a plurality of spaced-apart projections; and further comprises a flock coating covering at least the first and second surfaces. The flat surface of the apparatus is used for removing dust from a generally flat surface, whereas the surface with spaced-apart projections is used for removing dust from more complex surfaces and from nooks which cannot be reached using the flat surface of the apparatus. The resilient body is preferably made of a foam material. Although the body may be of virtually any shape, polyhedral shapes are preferred in order to provide a plurality of dusting surfaces.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
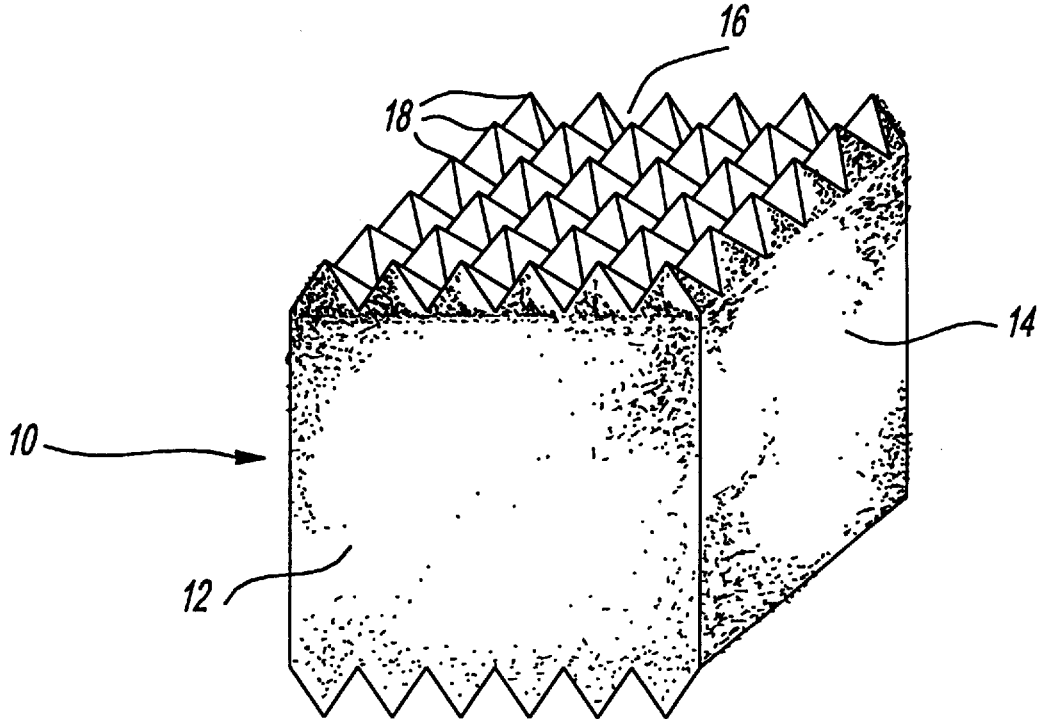
FIG. 1 is a perspective view of a first embodiment of the present invention.

FIG. 1 illustrates an apparatus 10 constructed in accordance with the present invention. Apparatus 10 has a generally cube-shaped body made of a resilient material. Sides 12 and 14 of the cube are substantially flat. Side 16 has a plurality of spaced-apart projections 18. These projections may be pyramidal in shape or may be of alternate shapes such as conical, hemispherical, etc. Projections 18 facilitate removal of dust from contoured surfaces, nooks, etc.

Apparatus 10 may have any combination of flat surfaces and surfaces with projections. In one embodiment, two opposing surfaces of the cube are provided with projections, all other surfaces being substantially flat. Other combinations are within the scope of the invention; however, for best utility, there should be at least one of each type of surface.

The body of apparatus 10 should be made of a suitably resilient material. In one embodiment, a polyurethane foam having 45 lb. indentation force deflection (IFD) and a density of approximately 1.45 pounds/cubic foot is used. Other equal suitably resilient materials will be recognized by those skilled in the art.

Apparatus 10 is coated with a flocking material to enhance its dust collection capabilities. While it is preferred that all surfaces of apparatus 10 be flocked, this is not necessary as long as flocking is applied to at least one substantially flat surface and at least one surface having projections. The flocking is applied using an electrostatic process as is well known in the art. In one embodiment, the flock comprises nylon fibers of 0.020 inch length and 1.5 denier.

Figure 2:
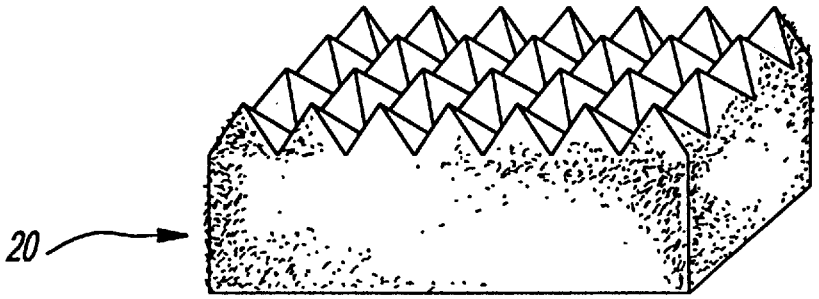
FIG. 2 is a perspective view of a second embodiment of the present invention.

FIG. 2 illustrates an alternative embodiment of the invention in the shape of a rectangular prism. Except for its overall shape, apparatus 20 is otherwise identical in construction to apparatus 10. It will be recognized that an apparatus according to the present invention may be constructed in a wide variety of other polyhedral shapes.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An apparatus for removing dust from an object comprising:

a resilient body having a first substantially flat surface and a second surface having a plurality of spaced-apart pointed projections; and a flock coating covering said first and second surfaces.

2. The apparatus of claim 1 wherein said body is in the shape of a polyhedron.

3. The apparatus of claim 1 wherein said body is in the shape of a rectangular prism.

4. The apparatus of claim 1 wherein said body is generally in the shape of a cube.

5. The apparatus of claim 1 wherein said body is made of foam.

6. The apparatus of claim 1 wherein said flock coating comprises nylon fibers.

7. The apparatus of claim 1 wherein the spaced-apart projections are pyramidal.

8. An apparatus for removing dust from an object comprising:

a resilient body having a first substantially flat surface and second and third surfaces each having a plurality of spaced-apart projections; and a flock coating covering said first, second and third surfaces.

9. The apparatus of claim 8 wherein said body is in the shape of a polyhedron.

10. The apparatus of claim 8 wherein said body is in the shape of a rectangular prism.

11. The apparatus of claim 8 wherein said body is generally in the shape of a cube.

12. The apparatus of claim 8 wherein said body is made of foam.

13. The apparatus of claim 8 wherein said flock coating comprises nylon fibers.

14. The apparatus of claim 8 wherein the spaced-apart projections are pointed.

15. The apparatus of claim 8 wherein the spaced-apart projections are pyramidal.

* * * * *

UNITED STATES PATENT AND TRADEMARK OFFICE

CERTIFICATE OF CORRECTION

PATENT NO. : 5,806,135

DATED : September 15, 1998

INVENTOR(S) : Earle

It is certified that error appears in the above-identified patent and that said Letters Patent is hereby corrected as shown below:

Title page,

Item [21], Appl. No., please delete "711,868" and insert -- 08/771,868 --.

Item [56], References Cited, patent number 5,336,330, please delete "Shumway et al." and insert -- 5,351,356 --.

Signed and Sealed this

First Day of May, 2001

*Attest:*

Nicholas P. Godici

NICHOLAS P. GODICI

*Attesting Officer*

*Acting Director of the United States Patent and Trademark Office*